US008092965B2

(12) United States Patent
Anno et al.

(10) Patent No.: US 8,092,965 B2
(45) Date of Patent: Jan. 10, 2012

(54) TWO COMPONENT DEVELOPER AND IMAGE FORMING METHOD

(75) Inventors: Masahiro Anno, Tokyo (JP); Masahiko Nakamura, Tokyo (JP); Tsuyoshi Uchida, Tokyo (JP); Kenichi Onaka, Tokyo (JP); Junya Onishi, Tokyo (JP); Naoya Tonegawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 457 days.

(21) Appl. No.: 12/372,109

(22) Filed: Feb. 17, 2009

(65) Prior Publication Data

US 2009/0208862 A1 Aug. 20, 2009

(30) Foreign Application Priority Data

Feb. 20, 2008 (JP) ..... 2008-038693

(51) Int. Cl.
*G03G 9/00* (2006.01)

(52) U.S. Cl. ..... 430/108.7; 430/108.1; 430/111.1; 430/123.51

(58) Field of Classification Search ..... 430/108.1, 430/108.6, 108.7, 111.1, 111.3, 123.4, 123.41, 430/123.51

See application file for complete search history.

(56) References Cited

U.S. PATENT DOCUMENTS 6,258,502 B1 * 7/2001 Nakamura et al. ..... 430/110.4
6,844,126 B2 * 1/2005 Ohmura et al. ..... 430/110.3

FOREIGN PATENT DOCUMENTS

JP 2001330985 11/2001
JP 2004287269 10/2004
JP 2007079578 3/2007

* cited by examiner

*Primary Examiner* — Mark F Huff
*Assistant Examiner* — Stewart Fraser
(74) *Attorney, Agent, or Firm* — Lucas & Mercanti, LLP

(57) ABSTRACT

Provided is a method for forming an image containing the steps of: (a) forming an electrostatic latent image on an electrostatic latent image carrier; and (b) developing the electrostatic latent image by a two component developer comprising a toner and a carrier, wherein the two component developer is continually replenished in the developing step (b); and the toner includes: colored particles; and external additive particles comprising a complex oxide incorporating silicon atoms and at least one of titanium atoms and aluminum atoms, and a surface existing ratio of the silicon atoms ($R_2$) in a surface of the external additive particles being larger than an average existing ratio of the silicon atoms ($R_1$) in an entirety of the external additive particles.

20 Claims, 3 Drawing Sheets

TWO COMPONENT DEVELOPER AND IMAGE FORMING METHOD

This application is based on Japanese Patent Application No. 2008-038693 filed on Feb. 20, 2008 with Japan Patent Office, the entire content of which is hereby incorporated by reference.

TECHNICAL FIELD

The present invention relates to a two component developer which is employed in development adopting a so-called trickle developing system and an image forming method

BACKGROUND

In recent years, specifically along with progress of networks capable of readily sending digital system data, image forming methods employing an electrophotographic system have widened the application region from simple copying action to formation of original images and the use as a so-called alternative to printing.

Consequently, in the above technology, it has been desired to form stable images over an extended period. Further, it is desired to extend the replacement cycle of developers as long as possible.

On the other hand, in the image forming method employing the electrophotographic system, in order to form stable images, it has been considered that it is preferable to employ a two component developer composed of a carrier and a toner. The reason is that since the carrier exhibits charge providing capability, it is capable of assuredly providing charge to the toner, and further, since many triboelectric charge providing sites exist, it is possible to realize a rapid charge rise, whereby it is considered to be appropriate for high speed development.

While employing the two component developer, in order to extend its replacement cycle, it is essential to retard adhesion of the toner to the carrier, and many measures to retard toner adhesion have been proposed However, since eventually, it outlives its usefulness, it necessitates replacement of the entire developer.

In order to decrease the above replacements of the developer as least as possible, proposed is an image forming method called a so-called trickle developing system in which the used developer is gradually removed, while the toner and the carrier in an amount equivalent to the removed is replenished (refer, for example, to Patent Documents 1-3).

In the above trickle developing system, the used developer is gradually removed from the interior of the developing device, and carrier in the corresponding amount and toner in the amount used for image formation and in the amount in the developer which has been removed are intermittently or continuously replenished. By employing the above system, since the deteriorated developer (being the carrier) is gradually replaced with fresh one, excessive deterioration of the developer is retarded, whereby it has been known that no replacement of the developer is required over an extended period.

However, in the image forming method of the above trickle developing system, problems result in which during the use over an extended period, degradation and deterioration of image quality such as background density increase or toner scattering, or staining of the interior of the device occurs.

(Patent Document 1) Japanese Patent Publication Open to Public Inspection (hereinafter referred to as JP-A) No. 2001-330985

(Patent Document 2) JP-A 2004-287269

(Patent Document 3) JP-A 2007-079578

SUMMARY

In view of the foregoing, the present invention was achieved. An object of the present invention is to provide a two component developer which is intermittently replenished into the development process employed in a trickle developing system and which retards formation of image defects such as an increase in background density during the use over an extended period so that it is possible to form high quality images of high resolution without image defects over an extended period Further, another object of the present invention is to provide an image forming method employing the aforesaid two component developer in the image forming method employing the trickle developing system.

The inventors of the present invention conducted detailed analysis of the problem generating situation when the inventors of the present invention employed the trickle developing system. As a result, it was assumed that the difference in charging characteristics between the replenished carrier and the residual carrier in the interior Of the developing device was the cause of degradation and deterioration of image quality and staining within the device.

The inventors of the present invention conducted diligent investigation to overcome the above problems. Minute external additive particles incorporated in the toner are composed of relatively insulating materials such as silica. When excessively charged, the resulting particles migrate to the carrier to lower its charging property. When fresh new carrier is replenished in such a state, the difference in charge providing capability of both is increased, and the charge amount distribution of the toner broadens, whereby toners of both a high charge amount and a low charge amount coexist. As a result, it is assumed that an increase in background density and toner scattering resulted.

In order to overcome the problems of degradation and deterioration of image quality due to toner scattering and the increase in background density and formation of staining in the interior of the device, it was assumed that in order to retard the migration of minute external additive particles to the carrier, it was necessary to retard excessive charging of the minute external additive particles, whereby the present invention was accomplished.

One of the embodiments of the two component developer of the present invention is one which is continually replenished in a developing process in the image forming method in which an electrostatic latent image formed on the electrostatic latent image carrier is visualized by the two component developer composed of a toner and a carrier, and the aforesaid toner is composed of at least colored particles and minute external additive particles. The aforesaid minute external additive particles are composed of a complex oxide incorporating silicon atoms, and at least one of titanium atoms and aluminum atoms, and the surface existing ratio of silicon atoms ($R_2$) in the above surface is higher than the average existing ratio of silicon atoms ($R_1$) in the whole. Here, the complex oxide is an oxide compound containing at least two kinds of metal atoms.

The surface existing ratio of the silicon atoms ($R_2$) is defined as a value obtained from a weight of silicon atoms in the surface divided by the total weight of the silicon atoms, the titanium atoms and the aluminum atoms in the surface.

The average existing ratio of the silicon atoms ($R_1$) is defined as a value-obtained from a weight of silicon atoms in the entirety of the external additive particles divided by the total weight of the silicon atoms, the titanium atoms and the aluminum atoms in the entirety of the external additive particles.

One of the embodiments of the present invention, the external additive particles preferably have a coefficient $(R_1)/(R_2)$ of not more than 0.7, where $R_1$ is an average existing ratio of silicon atoms in the whole of the external additive particles, and $R_2$ is a surface existing ratio of silicon atoms in a surface of the external additive particles.

One of the embodiments of the present invention, the external additive particles preferably contain a total amount (mass) of the titanium atoms and the aluminum atoms contained in the external additive particles is higher than an amount of the silicon atoms in the external additive particles. Further, it is preferable that the aforesaid external additive particles has a number average primary particle diameter of 20 to 200 nm.

One of the embodiments of the image forming methods of the present invention is a method comprising the steps of:

(a) forming an electrostatic latent image on an electrostatic latent image carrier; and (b) developing the electrostatic latent image by a two component developer comprising a toner and a carrier, wherein the two component developer is continually replenished in the developing step (b); and the toner comprises:

colored particles; and external additive particles comprising a complex oxide incorporating silicon atoms and at least one of titanium atoms and aluminum atoms, and a surface existing ratio of silicon atoms in a surface of the external additive particles being higher than an average existing ratio of silicon atoms in the whole of the external additive particles.

With regard to the two component developer of the present invention, the toner incorporates specific minute external additive particles. Since the aforesaid specific minute external additive particles are those in which generation of excessive charge is retarded, and migration to the carrier is retarded. Consequently, it is possible to reduce the difference in the charge providing capability between the carrier retained in the developing device and the newly replenished carrier to sharpen the charge amount distribution of the toner in the developing device, whereby it is possible to retard toner scattering and the increase in background density. In addition, since the aforesaid specific external additive particles exhibit sufficient charging property, it is possible to stably form high quality images over an extended period.

Reasons, in which while the specific minute external additive particles, incorporated in the toner, exhibit sufficient charging property, excessive charge is retarded, whereby migration to the carrier is retarded, are assumed to be as follows.

Namely, silica, which is an oxide of silicon atoms, is structured to be readily charged and to hold the resulting charge. However, due to the structure to easily hold charge, charge is accumulated.

On the other hand, since oxides of titanium atoms and aluminum atoms exhibit relatively low resistance, they are capable of leaking charge, while charge holding becomes difficult.

The following assumption may be made. In the specific minute external additive particles employed in the present invention, many oxides having silicon atoms (hereinafter referred to as silica components) are oriented in the surface. Consequently, when colored particles are subjected to an addition treatment of external additives, charge providing capability is sufficiently realized. In addition, due to the presence of a structure in which a large amount of relatively low resistance components, such as oxides (hereinafter referred to as "titania and/or alumina components") having titanium atoms and/or aluminum atoms in the interior, excessive charge generated by the silica component in the surface is allowed to leak to the interior of the aforesaid minute external additive particles via titania and/or alumina components in the interior, whereby it is possible to control excessive charge.

Based on the image forming method of the present invention, since images are formed by employing the above two component developer, it is possible to stably form high quality images over an extended period.

Incidentally, it is possible to retard migration to the carrier by employing minute low resistant particles, themselves composed of metal oxides such as titanium oxide or aluminum oxide. However, since charge providing capability to colored particles constituting the toner fluctuates depending on ambient variation, the desired charging property is not attained.

DESCRIPTION OF THE PRESENT EMBODIMENTS

Figure 1:
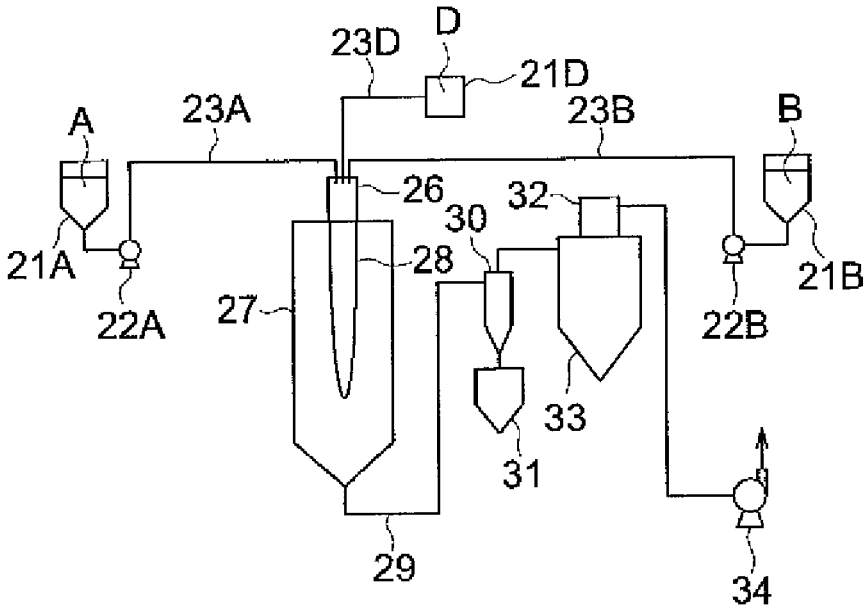
FIG. 1 is a schematic view showing one example of manufacturing facilities which manufacture minute external additive particles which constitute the toner of the two component developer of the present invention employing a gas phase method via powders.

The present invention will now be detailed.

The two component developer of the present invention is one which is continually replenished to a developing process in the image forming method in which an electrostatic latent image formed on the electrostatic latent image carrier is visualized by the two component developer composed of a toner and a carrier, and the aforesaid toner is composed of at least colored particles and minute external additive particles. The aforesaid minute external additive particles are composed of a complex oxide incorporating silicon atoms, and at least one of titanium atoms and aluminum atoms, and the existing ratio of silicon atoms in the above surface is higher than that of silicon atoms in the whole. Such minute external additive particles will also be designated as "specific minute external additive particles".

Since the above minute external additive particles are ones in which silicon atoms exist at the surface in a large amount, toner, which is prepared in such a manner that these are subjected to an external treatment to colored particles, is statically stored, excellent fluid characteristics, which are similar to particles via silica, are exhibited in such a manner that a packing phenomenon, which is generated when minute external additive particles composed, for example, of titanium oxide, is not generated.

(Specific Minute External Additive Particles)

In the specific minute external additive particles, "existing ratio of silicon atoms at the surface is higher than that of silicon atoms in the whole" means that more silicon atoms exist at the surface and coefficient $(R_1)/(R_2)$ is less than 1, where $R_1$ is an average existing ratio of silicon atoms in the whole, while $R_2$ is a surface existing ratio of silicon atoms at the surface.

Silicon atom coefficient $(R_1)/(R_2)$ is preferably at most 0.7, is more preferably at most 0.5, but is most preferably at most 0.25.

An average existing ratio $R_1$ of silicon atoms in the entire specific external additive particles is determined as follows. The content by weight of silicon atoms, titanium atoms and/or aluminum atoms in the whole is determined via a fluorescent X-ray analysis (XRF) apparatus "XRF-1800" (produced by Shimadzu Corp.) and existing ratio $R_1$ is calculated in terms of mass fraction.

In practice, the determination is carried out via the following (1)-(3) procedures. (1) Firstly, as a sample to prepare a calibration curve, pellets are prepared by adding silicon dioxide of known weight to 100 parts by weight of styrene powders In the same manner as above, pellets to determine titanium atoms, which is prepared by adding titanium dioxide of known weight to 100 parts by weight of styrene powders and/or pellets to determine aluminum atoms which are prepared by adding aluminum oxide of known weight to 100 parts by weight of styrene powders were prepared. (2) Subsequently, each of the prepared pellets prepared to determine silicon atoms, the pellets prepared to determine titanium atoms and/or the pellet prepared to determine aluminum were subjected to fluorescent X-ray analysis, and with regard to silicon dioxide, titanium oxide or aluminum oxide in the styrene powders, a calibration curve is prepared via the peak intensity obtained from each of the pellets. (3) Thereafter, the specific minute external additive particle sample is subjected to fluorescent X-ray analysis, and by collating the resulting peak intensity with the calibration curve, the silicon atoms, the titanium atoms, and/or the aluminum atoms are subjected to quantitative analysis.

Incidentally, in the above determination, a Kα peak angle was determined via the 2θ table and employed. Further, conditions of the X-ray generating section were Rh tube voltage: 40 kV, tube electric current: 95 mA, filter: not used, while spectroscopic conditions were slit: standard, attenuator: not used, spectroscopic crystal: (Si═PET, Ti═LiF, and Al═PET), and detector: (Si═FPC, Ti═SC, and Al═FPC).

On the other hand, a surface existing ratio $R_2$ of silicon atoms at the surface of the specific minute external additive particles was determined as follows. The content by weight of silicon atoms, titanium atoms, and aluminum atoms in the surface in the depth range of its surface to a depth of several nm (being an approximately 10-atom layer) was determined via an X-ray photoelectron spectrometer (XPS) "ESCA-1000" (produced by Shimadzu Corp.), whereby calculation was made in terms of mass fraction.

In practice, in the same manner as in determination procedures (1) and (2) employing the above fluorescent X-ray analysis (XRF) instrument, calibration curves of silicon atoms, titanium atoms and aluminum atoms were prepared, and under the following conditions, a specific external additive particle sample was subjected to X-ray photoelectron spectrometry.

Determination Conditions:

X-ray intensity: 30 mA, 10 kV

Analysis depth: Normal mode

Quantitative element: simultaneous quantitative analysis of Si, Ti, and Al elements In the specific minute external additive particles, the average existing ratio of silicon atoms in the whole is preferably 1-49%, but is more preferably 1-20%.

Further, in the specific minute external additive particles, the surface existing ratio of silicon atoms in the range of the surface to a depth of several nm in the surface is preferably 70-100%, but is more preferably 80-100%

When the average existing ratio of silicon atoms in the entire minute external additive particles is less than 1%, concern may result in which the resulting minute external additive particles exhibit no sufficient charging property and fluidity of a toner which is prepared via the external addition to colored particles is not exhibited as desired. On the other hand, when the average existing ratio of silicon atoms in the aforesaid entire minute external additive particles exceeds 49%, concern may result in which the resulting minute external additive particles are not able to sufficiently retard excessive charge. Further, when the surface existing ratio of silicon atoms in the surface is less than 70%, concern may result in which charge providing capability to colored particles is degraded.

(Average Diameter of Minute External Additive Particles)

The number average diameter of the primary particles of the specific minute external additive particles is preferably 10-500 nm, is more preferably 20-300 nm, but is most preferably 20-200 nm.

When the number average diameter of the primary particles is regulated within the above range, it is possible to stabilize the charge at the surface of colored particles, and to retain the aforesaid specific minute external additive particles themselves at the surface of colored particles, while maintaining high stability.

The number average diameter of the specific minute external additive particles is determined via a scanning type electron microscope (SEM).

In practice, an SEM photograph, which is enlarged by a factor of 30,000, is read via a scanner, and minute external additive particles existing on the toner surface of the aforesaid SEM photographic image are subjected to binarization via an image processing analyzing instrument "LUZEX AP" (produced by NIRECO Corp.). Subsequently, 100 Ferre diameters in the horizontal direction of one type of the minute external additive particles are calculated, and the average value is designated as the number average diameter of the primary particles.

Incidentally, when the number average diameter of the primary particles of the minute external additive particles is small and they exist on the toner surface in the form of aggregates, the diameter of the primary particles forming the aforesaid aggregates is to be determined.

(Specific Surface Area of Minute External Additive Particles)

The BET specific surface area of the specific minute external additive particles is preferably 2-100 $m^2/g$.

"BET specific area", as described herein, refers to the specific surface area which is calculated by utilizing the BET adsorption isotherm formula from the adsorption amount of the gas of which adsorption occupied area is known.

By regulating the BET specific surface area of minute external additive particles within the above range, the minute external additive particles are not buried within the colored particles and are not released from the surface of the colored particles, whereby an ambience is formed so that stable actions are achieved as an external additive.

The BET specific surface area is the value which is determined via a multipoint method (being a 7-point method)

employing an automatic specific area measuring apparatus "GEMINI 2360" (produced by Shimadzu-Micromeritics Co.).

In practice, initially, 2 g of minute external additive particles is placed in a straight sample cell, and as a pre-treatment, the cell interior is replaced with nitrogen gas (at a purity of 99.999%) over two hours. Thereafter, the calculation is made in such a manner that the minute external additive particles are subjected to adsorption and adsorption of nitrogen gas (at a purity of 99.999%) via the measurement apparatus itself.

(Bulk Density of Minute External Additive Particles)

Bulk density of the specific minute external additive particles is preferably 100-400 g/L.

In addition, "bulk density", as described herein, refers to the value which is obtained by dividing the weight of minute external agent particles filled in a known volume container by the above volume and refers to the existing degree of void formed among minute external additive particles per unit volume in the case in which the minute external additive particles are in a packed state.

By regulating the bulk density of the specific minute external additive particles within the above range, adhesion to colored particles constituting the toner is achieved, and further, the resulting toner results in high fluidity and enables retardation of desorption of minute external agent particles, whereby it is possible to reduce the adhesion onto charging rollers.

Bulk density of the specific external additive particles refers to the value which is determined via a Kawakita system bulk density meter "Type IH-2000" (produced by Seishin Enterprise Co., Ltd.).

In practice, a sample (being a specific toner) is placed on a 120-mesh sieve, vibrated at a vibration strength of 6 for 90 seconds, and allowed to fall into a container of known volume. After terminating the vibration, the resulting sample is allowed to stand still for 30 seconds. Thereafter, the sample in the container is leveled and the weight is determined, whereby the bulk density is calculated.

(Degree of Hydrophobicity of Minute External Additive Particles)

Degree of hydrophobicity of the specific minute external additive particles is preferably at least 30%.

By regulating the degree of hydrophobicity of the specific minute external additive particles to at least 30%, an advantage results in which under an ambience of high temperature and high humidity, desired charging property is realized.

The degree of hydrophobicity of the specific minute external additive particles refers to the value determined as follows. Namely, 50 mL of water is put into a 200 mL beaker and further, 0.2 g of minute external additive particles (being the sample) is added. While stirring the resulting mixture via a magnetic stirrer, methanol is added from a burette of which tip is immersed into the water while dripping. Subsequently, the dripped amount (Me) of methanol is recorded when the initially floating minute external additive particles (being the sample) completely sink. Then, calculation is made based on following Formula (1).

$$\text{Degree of hydrophobicity (\%)}=[Me(\text{mL})/(50+Me(\text{mL}))]\times 100 \qquad \text{Formula (1):}$$

The specific minute external additive particles are those in which the existing ratio of silicon atoms in the surface layer is higher than in the whole.

In practice, the specific minute external additive particles may be those in which a surface composed of silica components is formed on the surface of a nucleus particle composed of titania and/or alumina components. In addition, it is preferable that the above nucleus particle is composed of oxides incorporating silicon atoms.

In the case of the above embodiment, the surface composed of silica components may not always completely cover the nucleus particle. The existing ratio of the silica components determined via an X-ray photoelectron spectrometer is preferably 70-100% by weight, but is more preferably 80-100%.

The existing ratio of silica is determined via a measurement method which is the same as that which determines existing ratio $R_2$ Of silicon atoms in the surface of the aforesaid specific minute external additive particle while employing X-ray photoelectron spectrometer "ESCA-1000", produced by Shimadzu Corp.

(Manufacturing Method of Minute External Additive Particles)

Manufacturing methods of specific minute external additive particles incorporated in the two component developer of the present invention are not particularly limited, and examples thereof include a gas phase method, a pyrogenic process such as a flame hydrolysis method; a sol-gel method, a plasma method; a precipitation method; a hydrothermal method; a mining process (bergmaennische Verfahren); and combinations of the above processes. Of these, in view of easier regulation of exiting location of atoms, it is preferable to employ the pyrogenic process. Specifically listed may be the manufacturing method, employing the gas phase method, disclosed in Japanese Patent Publication No. 3202573.

The manufacturing method of minute external additive particles via the gas phase method, as described herein, refers to the method in which raw materials of minute external additive particles are introduced into a high temperature flame in a vapor or powder state, and minute external additive particles are manufactured by oxidizing the above.

When specific minute external additive particles in which silicon atoms are oriented on the surface are manufactured via a method (hereinafter also referred to as a "gas phase method via vapor") in which raw materials are introduced into a high temperature flame in a vapor state, in view of manufacturing stability, it is preferable that, for example, vapor which is prepared by vaporizing a titanium atom source and/or an aluminum atom source via heating is initially introduced, and after crystals grow to some extent, vapor, which is prepared by vaporizing the silicon atom source, is introduced.

As the silicon atom sources, listed are silicon halides such as silicon tetrachloride or organic silicon compounds; as titanium atom sources, listed are titanium sulfate and titanium tetrachloride; and further, as aluminum atom sources listed are aluminum chloride, aluminum sulfate, and sodium aluminate.

On the other hand, when the specific minute external additive particles, in which silicon atoms are oriented on the surface, are manufactured via a method (hereinafter also referred to as "a gas phase method employing powders") in which raw materials in a powder state are introduced into a high temperature flame, it is preferable that for example, during introduction of powders which form nucleus particles (hereinafter also referred to "nucleus particle forming powders") and powders (hereinafter also referred to as "modifying powders") which form a surface via surface modification in a high temperature flame, in view of manufacturing stability, it is preferable that the particle size of the nucleus particle forming the powders is regulated to be greater than that of the modifying powders.

The above reason is assumed to be as follows. Nucleus particle forming powders and modifying powders are introduced in the same high temperature flame, and when a plurality of powders is subjected to coalescence and growth in the above high temperature flame to form particles of a larger diameter, by decreasing the particle size of the modifying powders, the heat receiving area of the modifying powders increases to result in a state which is more easily melted. Accordingly, for example, by regulating the temperature of the high temperature flame, the degree of coalescence and growth of nucleus particle forming powder is retarded to become low, whereby it is possibly to find melting and adhering conditions of the modifying powders without special trial and error.

In the foregoing, it is assumed that by simultaneously introducing the nucleus particle forming powders and the modifying powders into a high temperature flame, the surfaces are modified with each other.

In the aforesaid manufacturing method, as nucleus particle forming powders, employed are particles composed of metal oxides such as a component of titanium and/or alumina. As the above nucleus particle forming powders, preferred are those composed of oxides incorporating silicon atoms.

It is possible to prepare nucleus particle forming powders composed of metal oxides in such a manner that raw materials of the aforesaid metal oxides are combusted in a flame. As raw materials of metal oxides, listed may be those which are listed in the above as a titanium atom source, or an aluminum atom source. These may be employed individually or in any appropriate combinations.

On the other hand, as modifying powders, employed are those composed of silica. In practice, preferably employed are those which are prepared by combusting the silicon atom source, listed above, in a high temperature flame. In addition, in view of environmental safety, it is preferable to employ, as silica, those which are amorphous.

It is preferable that silica is subjected to adhesion and fusion via heat so that on the surface of the nucleus particles, it is not possible to observe the prototype of silica.

FIG. 1 is a schematic view showing one example of production facilities which manufacture, via the gas phase method employing powders, minute external additive particles incorporated in the toner of the two component developer of the present invention. Incidentally, production facilities to manufacture the specific external additive particles according to the present invention are not limited thereto.

The above is a case in which minute external additive particles are manufactured via the gas phase method employing powders. A case in which when minute external additive particles incorporating, for example, silicon atoms, titanium atoms or aluminum atoms are manufactured, it is possible to practically manufacture them as follows.

Namely, firstly, nucleus particle forming powder A placed in tank 21A for nucleus particle forming powder A and modifying powder B placed in tank 21B for modifying powder B, each is introduced into main burner 26, fitted with a spray nozzle at the tip through introduction pipes 23A and 23B via metering supply pumps 22A and 22B, and further, is sprayed into a burner reactor along with oxygen water vapor mixed gas D, whereby ignition is made via a subsidiary flame and high temperature flame 28 is formed.

Further, minute external additive particles are formed via burning, and the resulting minute external additive particles are cooled, together with the exhaust gas, in gas duct 29, separated from the exhaust gas via bag filter 32. Each is collected via recovery units 31 and 33. The exhaust gas, separated from the minute external additive particles, is exhausted via an exhausting unit.

Incidentally, in FIG. 1, 21D is a tank of oxygen water vapor mixed gas D, while 23D is an introduction pipe of the oxygen water vapor mixed gas.

Figure 2:
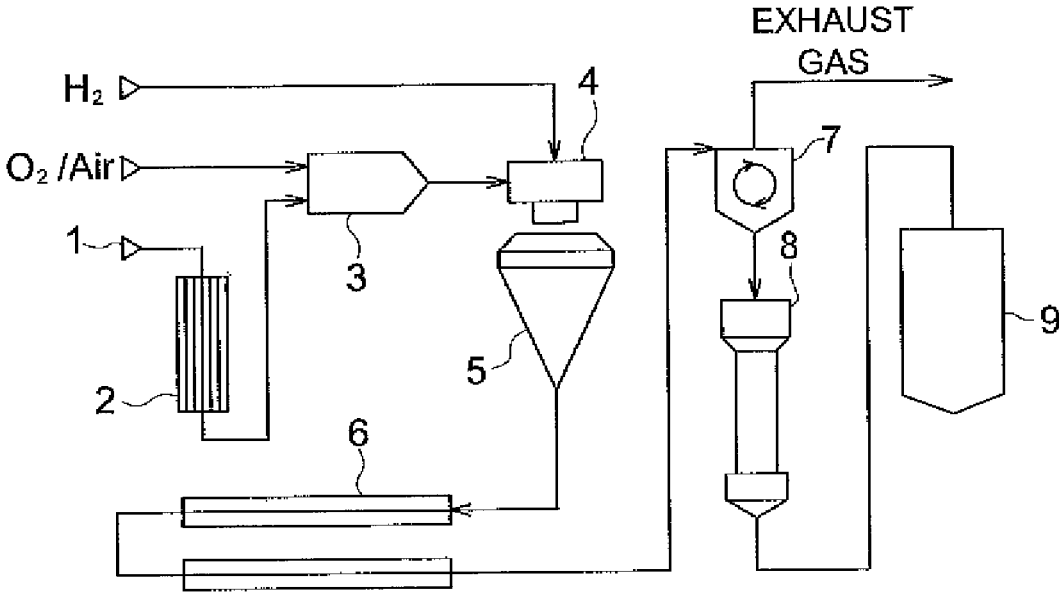
FIG. 2 is a schematic view showing one example of manufacturing facilities which manufacture the minute external additive particles which constitute the toner of the two component developer of the present invention employing a gas phase method via steam.

FIG. 2 is a schematic view showing one example of production facilities which manufacture minute external additive particles which constitute the toner employed in the image forming method of the present invention via the gas phase method employing vapor. Incidentally, production facilities which manufacture the specific minute external additive particles according to the present invention via the gas phase method employing vapor are not limited thereto.

In the case of production of minute external additive particles via the above gas phase method employing vapor, when minute external additive particles incorporating, for example, silicon atoms, titanium atoms, and aluminum atoms, in practice, production may be conducted as follows.

(1) Initially, a silicon atom source, a titanium atom source, and an aluminum atom source are put into evaporator 2 through raw material slot 1 and are heated and vaporized to prepare a vapor related to silicon, a vapor related to titanium, and a vapor related to aluminum. (2) Subsequently, these vapors are introduced into mixing chamber 3 together with inert gases (not shown), and a mixed gas is prepared by mixing the above gas with desiccated air and/or oxygen gas, hydrogen gas at a specified ratio. The resulting mixed gases are introduced into a combustion flame (not shown) formed in reaction chamber 5 from combustion burner 4. (3) By conducting combustion in a combustion flame in the temperature range of 1,000-3,000° C., particles incorporating silicon atoms. titanium atoms, and aluminum atoms are prepared. (4) After cooling the prepared particles in cooling unit 6, gaseous reaction products are separated and removed in separating unit 7. During the above operation, in some cases, hydrogen chloride, which is adhered onto the particle surface in moist air, is removed. Further, in processing chamber 8, hydrogen chloride undergoes deacidification treatment, collected by a filter, and complex oxide particles are recovered in silo 9.

In the manufacturing method described above, the flow rate ratio of vapor related to silicon, vapor related to titanium, and vapor related aluminum, which are introduced into the combustion flame, the introducing timing of each vapor to the combustion flame, the combustion time, the combustion temperature, the combustion ambience, and other combustion conditions affect the orientation state of silicon atoms on the surface of the specific minute external additive particle. Consequently, in the present invention, in order to orient titanium atoms and aluminum atoms into the interior and silicon atoms onto the surface, it is preferable that these conditions are subjected to composite regulation.

The state in which silicon atoms are oriented at the surface is realized via, for example, delayed timing of introduction of the vapor related to silicon into the combustion flame or an increase in concentration of the vapor related to silicon in the entire passing vapor during the latter half of the reaction.

In practice, in view of production stability, it is preferable that the vapor related to titanium, exhibiting relatively low electrical resistance, and/or vapor related to aluminum, are introduced into the combustion flame in advance (or the concentration of the vapor related to silica in the entire passing vapor is decreased during the first half of the reaction), and after crystals grow to some extent, the vapor related to silicon, exhibiting relatively high electrical resistance is introduced (the concentration of the vapor related to silicon in the entire passing vapor during the first half of the reaction is increased).

The resulting composite oxide particles may be employed as minute external additive particles without modification.

However, it is preferable that the above composite oxide particles are subjected to a hydrophobic treatment.

As a hydrophobic treatment method, listed may be the dry system method described below.

Namely, hydrophobic agents are diluted with solvents such as tetrahydrofuran (THF), ethyl acetate, methyl ethyl ketone, acetone ethanol, or hydrogen chloride saturated ethanol. During vigorous stirring of the composite oxide particles in a blender, the above diluted solution of hydrophobic agents is added via dripping or spraying, and sufficient mixing is conducted. During the above operation, it is possible to employ apparatuses such as a kneading coater, a spray drier, a karmal processor, or a fluid bed.

Subsequently, the resulting mixture is transferred to a vat and dried by heating in an oven. Thereafter, sufficient pulverization is again carried out via a mixer or a jet mill. It is preferable that, it needed, the resulting pulverized ones are subjected to classification. In the method described above, when a hydrophobic treatment is carried out employing a plurality of types of hydrophobic agents, the treatments may be carried out by simultaneously employing each of them or the above treatments may be separately carried out.

Further, other than the above dry system method, the hydrophobic treatment may be carried out via wet system methods such a method in which composite oxide particles are immersed into an organic solvent solution of coupling agents, followed by drying, and another method in which composite oxide particles are dispersed into water to form slurries followed by dripping of an aqueous solution of hydrophobic agents, and thereafter the composite oxide particles are precipitated followed by drying and pulverization.

During the above hydrophobic treatment, it is preferable that the temperature during heating is at least 100° C. When the temperature is less than 100° C. during heating, composite oxide particles and hydrophobic agents tend to undergo incomplete condensation reaction.

As hydrophobic agents to be employed for the hydrophobic treatment, listed are silane coupling agents such as hexamethylsilazane, titanate based coupling agents, and those which are commonly employed as a surface treating agent, such as silicone oil, or silicone varnish. Further, also employed may be fluorine based silane coupling agents, fluorine based silicone oil, coupling agents having an amino group or a quaternary ammonium salt group, and modified silicone oil. It is preferable that these hydrophobic agents are employed in a state of dissolution in ethanol.

(Other Minute External Additive Particles)

Minute external additive particles incorporated in the toner of the two component developer of the present invention are not limited only to the specific minute external additive particles described above, and other appropriate minute external additive particles may be simultaneously employed.

As other minute external additive particles employed may be various minute inorganic and organic particles, as well as lubricating agents such as titanate compounds or metal stearate salts. It is preferable that as minute inorganic particles, employed are, for example, minute particles of inorganic oxides such as silica, titania, or alumina. Further, it is preferable that these minute inorganic particles are subjected to a hydrophobic treatment via silane coupling agents and titanium coupling agents. Further, as minute organic particles employed may be ball spherical ones at a number average diameter of the primary particles of about 10-about 2,000 nm. As the above minute organic particles employed may be polymers of polystyrene, polymethyl methacrylate, and styrene-methyl methacrylate copolymers.

As minute external additives other than the above, various ones may be employed in combinations.

(Adding Treatment of Minute External Additive Particles)

Toner is prepared by adding the minute external additive particles described above to colored particles to form the target toner.

During addition of the minute external additive particles, as a mixing apparatus, which is employed to add the minute external additive particles, employed may be mechanical mixing apparatuses such as a Henschel mixer or a coffee mill.

(Addition Ratio of Minute External Additive Particles)

With regard to the addition ratio of minute external additive particles, the addition ratio of the specific minute external additive particles is preferably 0.1-2.0% by weight with respect to the colored particles.

(Toner)

Toner which constitutes the two component developer of the present invention is one which incorporates colored particles and the specific minute external additive particles.

(Manufacturing Method of Colored Particles)

Methods to manufacture colored particles, which constitute toner, are not particularly limited and listed may be a pulverization method, a suspension polymerization method, an emulsion polymerization aggregation method, a dissolution suspension method, and a polyester molecule elongation method, as well as other conventional methods. Of these, it is preferable that colored particles, which constitute the aforesaid toner, are prepared via the emulsion aggregation method. Specifically, it is preferable to prepare the colored particles via the mini-emulsion polymerization aggregation method in which resin particles prepared through a multiple-stage polymerization by emulsion-polymerizing mini-emulsion polymerization particles are coalesced (aggregated/fused).

In practice, for example, the mini-emulsion polymerization aggregation method is one to prepare colored particles as follows. Oil droplets (10-1,000 nm) of a polymerizing monomer solution prepared by dissolving releasing agents in polymerizing monomers are formed in an aqueous medium prepared by dissolving surface active agents at a concentration which is higher than the critical micelle concentration while utilizing mechanical energy, whereby a dispersion is prepared, and minute binding resin particles, which are prepared in such a manner that water-soluble polymerization initiators are added to the resulting dispersion followed by radical polymerization, are subjected to coalescence (aggregation/fusion). Further, in the above mini-emulsion polymerization aggregation method, instead of adding water-soluble polymerization initiators, or together with the aforesaid water-soluble radical polymerization initiators, oil-soluble radical polymerization initiators may be added to the above monomer solution. Further, each of the minute binding resin particles may be composed of at least two layers which differ in composition. In such a case, it is possible to employ the method in which polymerization initiators and polymerizing monomers are added to a first resin particle dispersion prepared via mini-emulsion polymerization (being a first step polymerization) according to the conventional method, and this system undergoes polymerization (being a second step polymerization).

One example, in the case of employing the mini-emulsion polymerization aggregation method as a method to produce colored particles, will now be specifically described. The method includes (1) a dissolving and dispersing process which prepares a polymerizing monomer solution by dissolving or dispersing colored agents and if needed, toner constituting materials such as releasing agents or charge controlling agents in a polymerizing monomer solution; (2) a polymerization process in which oil droplets of the polymerizing monomer solution are formed in an aqueous medium; (3) an aggregating and fusing process in which aggregated particles are formed via salting-out, aggregation, and fusion in an aqueous medium; (4) a ripening process in which a dispersion of the colored particles is prepared by ripening aggregated particle via thermal energy to regulate their shape; (5) a cooling process in which the dispersion of colored particles are cooled; (6) a filtering and washing process in which the aforesaid colored particles are subjected to solid-liquid separation from the cooled colored particle dispersion, and surface active agents and the like are removed from the aforesaid colored particles; and (7) a drying process which dries the colored particles which have been washed.

"Aqueous medium", as described herein, refers to one which is composed of water as a major component (at least 50% by weight). As components other than water, listed may be water-soluble organic solvents, examples thereof include methanol, ethanol, isopropanol, butanol, acetone, methyl ethyl ketone, and tetrahydrofuran. Of these, specifically preferred are alcohol based organic solvents such as methanol, ethanol, isopropanol, or butanol, which do not dissolve the resins.

(Binding Resins)

When the colored particles, which constitute the toner according to the present invention, are manufactured via the pulverization method or the dissolution suspension method, as binding resins which constitute the colored particles of the toner, listed may be various conventional resins.

Further, when the colored particles which constitute the toner according to the present invention are manufactured via the suspension polymerization method, a mini-emulsion polymerization aggregation method, or the emulsion polymerization method, as polymerizing monomers to prepare various resins which constitute the toner, listed may be, for example, various conventional polymerizing monomers such as vinyl based monomers. Yet further, as polymerizing monomers, it is preferable to employ combinations of those having an ionic dissociating group. Still further, as polymerizing monomers, it is also possible to prepare binding resins having a crosslinking structure, employing polyfunctional vinyl based monomers.

(Colorants)

As colorants which constitute colored particles of the toner according to the present invention, employed may be conventional inorganic or organic colorants.

The added amount of colorants is commonly in the range of 1-30% by weight with respect to the colored particles, but is preferably in the range of 2-20% by weight.

(Internal Additives)

In the colored particles which constitute the toner according to the present invention, if needed, incorporated may be releasing agents and charge controlling agents. As the releasing agents and the charge controlling agents, employed may be any of the various conventional compounds.

(Diameter of Colored Particles)

The diameter of the colored particle, which constitutes the toner particles related to the two component developer of the present invention, is preferably 3-8 μm in terms of number average particle diameter. When the colored particles are formed via the polymerization method, in the toner manufacturing method described above, it is possible to control the above diameter via the concentration and added amount of aggregating agents, and the fusing period, as well as the composition of polymers themselves.

By regulating the number average particle diameter within 3-8 μm, it is possible to achieve desired reproduction of fine lines and enhanced quality of photographic images, as well as to reduce the toner consumption amount compared to the case of use of the toner of a large particle diameter (Carriers)

Carriers, which are mixed with the toner in the two component developer of the present invention, are not particularly limited, and various conventional ones may be listed. However, it is preferable to employ a resin coated carrier which is constituted in such a manner that a resin coating layer is formed on the surface of a magnetic core material.

As resins which form the resin coating layer of the carrier, those which are able to form a film may be listed without particular limitation. As such coating resins, it is preferable to employ (meth)acrylic acid ester based polymers, detailed below. Further, as the coating resins, it is possible to list (co)polymers of styrene and its derivatives.

As monomers which constitute (meth)acrylic acid ester based polymers, listed are, for example, esterified compounds of acrylic acid and methacrylic acid with aralkyl alcohol, halogenated alkyl alcohol, or aralkyl alcohol. These may be employed individually or in combinations.

Further, as monomers capable of forming (meth)acrylic acid esters via copolymerization with these monomers, listed are styrenes such as styrene or α-methylstyrene, addition polymerizing unsaturated carboxylic acids and esterified compounds thereof, aliphatic monoolefin, conjugated diene based aliphatic dioletin, nitrogen-containing vinyl compounds, vinyl acetates, vinyl ethers, and vinyl silane compounds.

In view of charging capability and coating layer forming capability, as (meth)acrylic acid ester based (co)polymers, specifically, it is possible to preferably employ homopolymers of acrylic acid esters or methacrylic acid esters and copolymers of these with styrene.

As acrylic acid esters and methacrylic acid esters, listed may be methyl acrylate, ethyl acrylate, n-butyl acrylate, 2-ethylhexyl acrylate, benzyl acrylate, methyl methacrylate, ethyl methacrylate, n-butyl methacrylate, t-butyl methacrylate, n-octyl methacrylate, 2-ethylhexyl methacrylate, cyclohexyl methacrylate, phenyl methacrylate, and benzyl methacrylate. These may be employed individually or in combinations.

As these (meth)acrylic acid ester based (co)polymers, ones of a weight average molecular weight (Mw) of 50,000-1,000,000 are preferred since high adhesion strength to magnetic core materials is realized so that the resulting carrier exhibits targeted durability.

As magnetic core materials to constitute a carrier, employed may be various conventional ones. However, since stress, which results during stirring and blending of the two component developer in the developing device is decreased and destruction of the resin coated layer and fusion of the toner onto the surface of the carrier tend to become difficult, it is preferable to employ magnetic particles such as magnetites or ferrites at a true specific gravity of 3-7 g/ml. In practice, as the magnetic core materials, those which are specifically preferred are magnetic particles composed of manganese ferrites, manganese magnesium ferrites, or lithium ferrites.

The volume average particle diameter of the carrier is preferably 20-100 μm, but is more preferably 25-80 μm.

It is possible to determine the volume average particle diameter of the carrier via a laser diffraction system particle size distribution meter "HELOS" (produced by SYMPATEC Co.) as a representative instrument.

(Manufacturing Method of Carrier)

It is possible to manufacture the resin coated carrier described as above via formation of a resin coated layer on the surface of magnetic core materials.

In practice, it is possible to provide the resin coated layer on the surface of magnetic core materials via a conventional dry system method, or a wet system method such as a solvent coating method or a solvent immersion method. Of these, in view of production cost and a decrease in environmental load, it is preferable to employ the dry system method.

Figure 3:
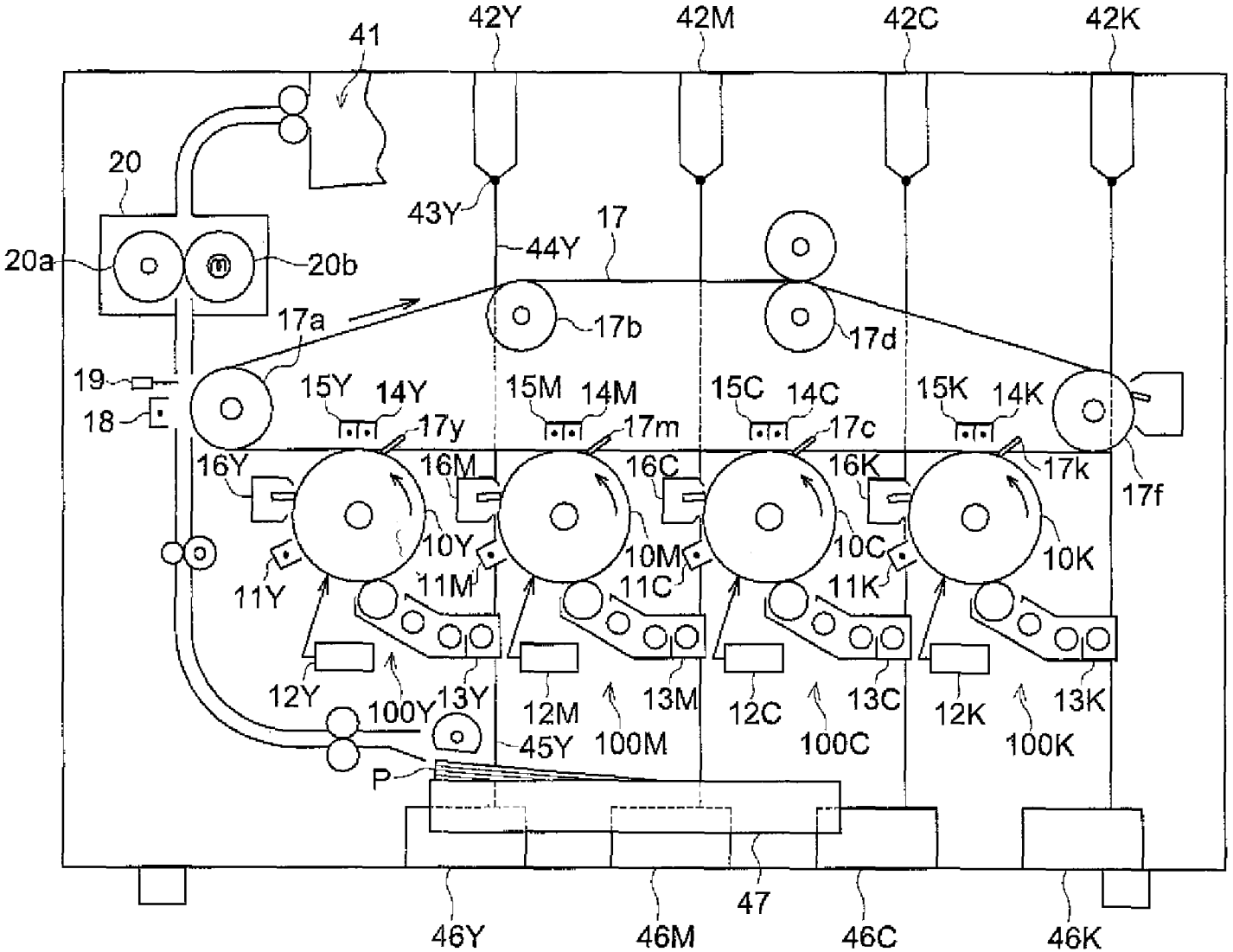
FIG. 3 is an explanatory view showing one example of the constitution of an image forming device employed in the image forming method of the present invention.

The above two component developer is employed, for example, in the image forming apparatus shown in FIG. 3 described below.

(Image Forming Apparatus)

The referred image forming apparatus is a color image forming apparatus, and a tandem system color image forming apparatus constituted in such a manner that four image forming units, 100Y, 100M, 100C, and 100K, are arranged along intermediate transfer belt 17 which is an intermediate transfer body.

Image forming units 100Y, 100M, 100C, and 100K are composed of photoreceptor drums 10Y, 10M, 10C and 10K, an electrostatic image carrier, each of which is driven via intermediate belt 17 which is hung to come into external contact with each of rollers 17*a*, 17*b*, 17*c*, and 17*f* and rotates counterclockwise so that the electrically conductive layer is grounded; charging means 11Y, 11M, 11C, 11K, composed of a scorotron charger, each of which is arranged in the perpendicular direction to the moving direction of photoreceptor drums 10Y, 10M, 10C, and 10K and provides uniform electrical potential on aforesaid photoreceptor drums 10Y, 10M, 10C, and 10K via corona discharge exhibiting identical polarity to the toner; exposure means which carry out scanning parallel to the rotation axis of each of photoreceptor drums 10Y, 10M, 10C, and 10K via, for example, a polygonal mirror and form an electrostatic latent image by carrying out image exposure onto each surface of uniformly charged photoreceptor drums 10Y, 10M, 10C, and 10K, based on image data, and developing devices 13Y, 13M, 13C, and 13K, which convey toner onto each surface of photoreceptor drums 10Y, 10M, 10C, and 10K and make the aforesaid electrostatic latent images visible.

In addition, the above developing devices 13Y, 13M, 13C, and 13K are operated via a so-called trickle developing system itself in which a toner and a carrier are gradually replenished from replenishing hoppers 42Y, 42M, 42C, and 42K, and further, the two component developer is gradually discharged into recovery boxes 46Y, 46M, 46C, and 46K.

Photoreceptor drums 10Y, 10M, 10C and 10K are rotated by driving intermediate transfer belt 17, in the direction shown by the arrow, via rotation of roller 17*a* via a driving source (not shown) and by pressing photoreceptor drums 1Y, 10M, 10C, and 19K via intermediate transfer belt 17 via pressing elastic plates 17*y*, 17*m*, 17*c*, and 17*k*, formed by a blade composed of, for example, urethane, arranged in the interior of intermediate transfer belt 17, on the downstream side of developing devices 13Y, 13M, 13C, and 13K in each of image forming units 100Y, 100M, 100C, and 100K and on the upstream side of the primary transfer region where the electrostatic latent image is subjected to a primary transfer via primary transfer means 14Y, 14M, 14C, and 14K and arranged within the interior of intermediate transfer means 14Y, 14M, 14C, and 14K.

Photoreceptor drums 10Y, 10M, 10C, and 10K are prepared in such a manner that an organic photoreceptor coating (OPC) provided with an over coat layer (being a protective layer) is provided on the outer peripheral surface of the cylindrical metal substrate composed of aluminum. The outer diameter is regulated, for example, to 100 mm.

Further, intermediate transfer belt 17 is, for example, a looped belt at a volume resistivity of $10^{12}$-$10^{15}$ Ω·cm. Specifically, preferred is a double layer structured one which is prepared in such a manner that a fluorine coating at a thickness of 5-50 μm is carried out as a toner filming prevention layer onto the external side of a substrate composed of a semiconductive film at a thickness of 0.1-1.0 mm, which is prepared by dispersing electrically conductive materials into engineering plastics such as modified polyimide or nylon alloy.

As a substrate to constitute intermediate transfer belt 17, other than the substrate composed of the semiconductive film described above, listed may be a substrate composed of semiconductive rubber at a thickness of 0.5-2.0 mm, which is prepared by dispersing eclectically conductive materials into silicone rubber or urethane rubber.

Further, in FIG. 3, 15Y, 15M, 15C, and 15K each is preferably composed of a corona discharging unit, and is a charge removing means of intermediate transfer belt 17 charged via primary transfer means 14Y, 14M, 14C, and 14K, while 16Y, 16M, 16C, and 16K each is a cleaning device to recover any residual toner remained on any of 10Y, 10M, 10C and 10K.

Yellow toner images are formed via image forming unit 100Y, magenta toner images are formed via image forming unit 100M, cyan toner images are formed via image forming unit 100C, while black toner images are formed via image forming unit 100K.

In the above image forming apparatus, a color toner image is formed in such a manner that each of the color toner images formed on photoreceptor drums 10Y, 10M, 10C and 10K is sequentially transferred onto rotating intermediate transfer belt 17 via, for example, primary transfer means 14Y, 14M, 14C, and 14K and superposed, whereby a color toner image is formed. In secondary transfer means 18, the superposed images are collectively transferred onto image support P conveyed from paper feeding tray 47, separated from intermediate transfer belt 17 via separation means 19, fixed in fixing device 20 constituted in such a manner that heating roller 20*b* and pressing roller 20*a* are subjected to pressed contact, and finally discharged through a discharge outlet.

Developing devices 13Y, 13M, 13C, and 13K in four image forming units 100Y, 100M, 100C, and 100K have the same constitution except that the color of each of the loaded toners differs with each other. In the following, developing device 13Y will be described as a representative unit.

Figure 4:
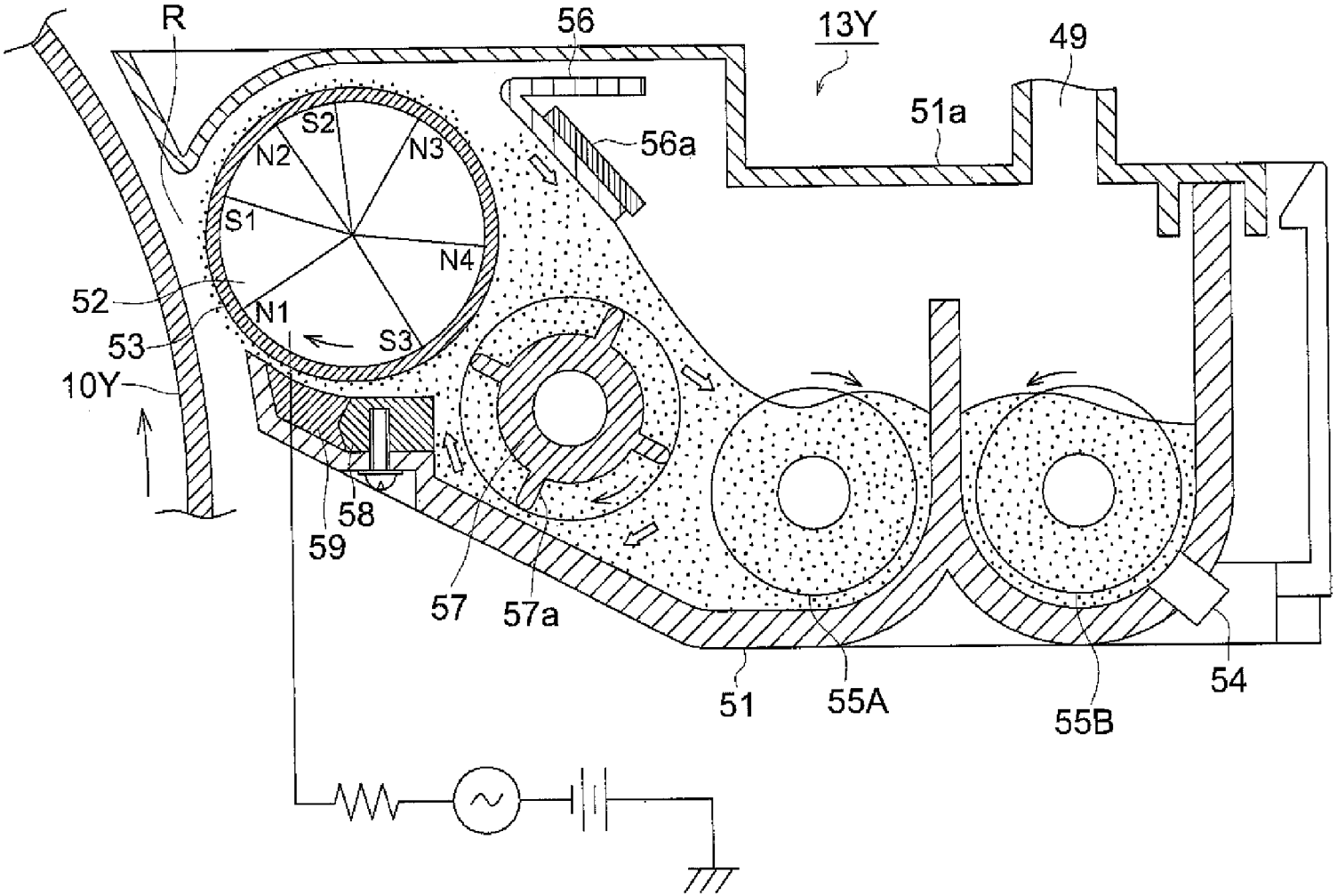
FIG. 4 is an explanatory view showing one example of the constitution of the developing device employed in the trickle developing system employing the two component developer of the present invention.

FIG. 4 is an explanatory view showing one example of the constitution of the developing device employed in the trickle developing system employing the two component developer of the present invention.

In the above developing device 13Y, the toner concentration of the two component developer, supplied to visualize toner images, which are blended while stirred in above developing device 13Y, is preferably 1-15%.

Further, the amount of the toner to be replenished (hereinafter referred to as "fresh toner") corresponds to the amount of the toner consumed in the development process, and the amount of the carrier to be replenished (hereinafter referred to as a "fresh carrier") is to be the amount so that in developing device 13Y, the two component developer substantially results in the same components.

Any carrier may be replenished individually or replenished in a state mixed with the fresh toner.

One example of the amount of fresh carrier follows. When fresh career is replenished as a mixture (hereinafter referred to as "fresh developer"), the amount of the carrier is considered to be preferably 5-35% by weight with respect to the toner, but more preferably 5-20% by weight.

Further, when only fresh carrier is replenished, it is preferable that for example, after every 1,000th image cycle, about 0.1-about 10 g of fresh carrier is replenished and about 50-5,000 g is replenished after every 500,000th image cycle. It is more preferable that the replenishment amount is about 0.5-about 5 g after every 1,000th image cycle and is about 250-about 2,500 g after every 500,000 image cycle.

In the above, when the fresh carrier replenished into developing device 13Y is excessively high, a large amount of the unnecessary fresh carrier is employed to increase the cost of use.

On the other hand, when the fresh carrier replenished into developing device 13Y is excessively low, the replacement of the carrier in the two component developer becomes insufficient, whereby it is impossible to realize the targeted effects via the trickle developing system.

In above developing device 13Y, the two component developer related to yellow is loaded in housing 51. As shown in FIG. 4, is incorporated developing sleeve 52 which rotates clockwise, as shown by the arrow, so that via a predetermined gap of such as 100-500 μm with respect to the peripheral surface of photoreceptor drum 10Y, in development zone R, movement is carried out in the same direction as aforesaid photoreceptor drum 10Y. A yellow toner image is formed by visualizing the electrostatic latent image on photoreceptor drum 10Y by carrying out a non-contact system reversal development in such a manner that the two component developer held on the peripheral surface of developing sleeve 52 is modified into a magnetic brush by applying, to aforesaid developing sleeve 52, development bias of direct current voltage or superimposition of direct and alternating current voltage.

It is possible to prepare developing sleeve 52 employing a cylindrical body of a thickness of such as 0.5-1 mm, and an outer diameter of 15-25 mm, which is composed of non-magnetic materials such as stainless steel or aluminum.

Magnet roller 53 is provided in developing sleeve 52. Above magnet roller 53 is composed of a cylindrical magnetic body provided with a plurality of magnetic poles N1, S1, N2, S2, N3, N4, and S3, and fixed at the same center in an internally enclosed in developing sleeve 52 and results in magnetic force action onto the outer peripheral surface of developing sleeve 52. The magnetic force of the magnetic pole constituting magnet roller 53 is preferably 500-1,200 gauss, but is more preferably 700-1,000 gauss. It is possible to determine magnetic force on the surface of developing sleeve 52 via a gauss meter.

In FIG. 4, 55A and 55B are stirring screws to prepare a two component developer which uniformly incorporates a toner and a carrier at a predetermined ratio and has been subjected to frictional electrification via rotation at the same rate in the opposite direction to stir and blend the two component developer in developing device 13, and 57 is a conveying and feeding roller. This conveying and feeding roller 57 conveys the developer scraped via removing plate 56 to stirring screws 55A and 55B and also feeds the two component developer which has been stirred and blended to developing sleeve 52.

Above conveying and feeding roller 57 is in a cross paddle shape in which on the outer peripheral surface of cylindrical column-shaped shaft member, for example, each of four plate-shaped feather members 57*a*, 57*a*, 57*a*, and 57*a* is arranged in separated positions at the same separate distance in the peripheral direction on the outer peripheral surface of the shaft member so that they extend beyond the diameter in the radial direction.

Further, in FIG. 4, 58 is a layer thickness regulating member composed, for example, of rod- or plate-shaped magnetic materials arranged via the predetermined gap from developing sleeve 52 to regulate, to a predetermined value, the thickness of the developer layer to be formed on the outer peripheral surface of developing sleeve 52. Further, 59 is composed of non-magnetic materials, and 56, which is a receiving member which modifies the developer layer regulated by layer thickness regulating member 58 to a stabilized state, is arranged facing magnetic pole N2 of magnet roller 53, and is a removing plate which scrapes off any developer on developing sleeve 52 via the action of a repulsive magnetic field of magnetic poles N2 and N3 with magnet plate 56*a* arranged on the backside.

Further, in above developing device 13Y, feeding outlet 49, employed to replenish fresh developer from the fresh developer replenishing mechanism (not shown) in housing 51, is formed at a position, above stirring screw 55B, in top plate 51*a* of housing 51.

In developing device 13Y described above, development is carried out as described below.

Namely, a two component developer loaded into housing 51 is stirred and blended via stirring screws 55A and 55B, and conveyed onto the outer peripheral surface of developing sleeve 52 via conveying and feeding roller 57. Thereafter, it adheres onto the outer peripheral surface of developing sleeve 52, and its thickness is regulated via layer thickness regulating member 58. The resulting is conveyed to developing region R. In aforesaid developing region R, non-contact system reversal development is carried out via application of developing bias voltage in which if desired, direct current (DC) voltage is subjected to superposition, via alternating current (AC) voltage between developing sleeve 52 and photoreceptor drum 10Y, whereby the noncontact system reversal development is carried out and an electrostatic latent image on photoreceptor drum is visualized.

On the other hand, the two component developer which has not visualized the electrostatic latent image is scraped off from developing sleeve 52 via action of the repulsive magnetic field of magnetic poles N2 and N3 and magnet plate 46*a* of removing plate 56 and again conveyed to stirring screws 55A and 55*b* via conveying roller and feeding roller 57.

In the above developing process, the fresh developing agent replenished from replenishing outlet 49 is stirred and blended via stirring screws 55A and 55B, and made available for development.

In practice, the fresh developer replenished from replenishing outlet 49 into housing 51 is stirred and blended with the toner and the carrier, both previously loaded into housing 51, via stirring screws 55A and 55B, whereby a two component developer, of in uniform toner concentration, is formed.

The above replenishment of the fresh developer in developing device 13Y is carried out, for example, via inspection of the toner concentration in housing 51, which is lower than the predetermined toner concentration, employing toner concentration inspecting sensor 54 provided at the bottom of housing 51.

In practice, any fresh developer fed to replenishing hopper 42Y is replenished into developing device 13Y through replenishing channel 44Y via rotation of feeding roller 43Y arranged at the bottom of replenishing hopper 42Y.

On the other hand, discharge of the two component developer from developing device 13Y is carried out, for example, by noting that the amount of the two component developing toner increases, namely the interfacial level of the two component developer in housing 51 is elevated, via a interfacial level inspecting means which is not shown.

In practice, stirring screws 55A and 55B are subjected to reverse rotation driving with respect to the period of normal stirring and blending. By such action, the two component developer is discharged from housing 51, and recovered in recovery box 46Y arranged at the bottom of the image forming apparatus via conveying screw 45Y which starts rotation at the same time of reverse rotation driving of stirring screws 55*a* and 55B.

Via the above operation, any excess two component developer in housing 51 is discharged, and by inspecting, via an interfacial level inspecting means, that the amount of the two component developer in housing 51 has decreased to a standard level, reverse rotation driving of stirring screws 55A and 55B is terminated, whereby discharging of two component developer is stopped.

In the image forming apparatus provided with developing device 13Y as described above, via a fresh developer replenishing mechanism, other than the above replenishing operation and discharging operation, for example, prior to image forming operations such as installation of a new image forming apparatus, namely prior to the operation of developing device 13Y, it is possible to carry out developer feeding operation in which the optimal amount of the two component developer exhibiting appropriate toner concentration is loaded into housing 51 of developing device 13Y, as well as a developer discharging operation which completely discharges the two component developer in housing 51 for its replacement after several ten thousand image forming operations.

By selecting the developer feeding operation, the amount of fresh developer fed by one rotation of feeding roller 43Y becomes nearly constant and the number of predetermined rotations of feeding roller 43Y is carried out, whereby it is possible to load the optimal amount of the two component developer exhibiting appropriate toner concentration into housing 51. Further, the above developer feeding operation may be carried out in such a manner that instead of loading a constant amount of the two component developer into housing 51, it is continuously fed, and an interfacial level detector detects the loading of its predetermined amount, the feeding is terminated.

Further, by selecting the developer discharging operation, stirring screws 55A and 55B are subjected to reverse rotation driving and conveying screw 45Y also rotates, whereby the two component developer is discharged followed by recovery into recovery box 46Y. Since stirring screws 55A and 55B are positioned at the lowest position of housing 51 and also positioned at the side edge portion, it is possible to discharge the entire two component developer in housing 51 by continuing reverse rotation driving of stirring screws 55A and 55B.

Control of developing device 13Y, as described above, is carried out independently with respect to each of developing devices 13Y, 13M, 13C, and 13K in respective developing devices 100Y, 100M, 100C, and 100K.

The trickle developing system developing device as described above, when applied to color image forming apparatuses such as a color printer, results in excellent effects.

(Image Supports)

Image support P, employed in the image forming method employing the two component developer of the present invention, is a support which carries toner images. Specific examples include, but are not limited to, various types of paper such as regular paper, from thin paper to cardboard, quality paper, coated printing paper such as art paper or coated paper, commercially available Japanese paper, postcard paper, and OHP plastic film.

With regard to the two component developer described above, the toner thereof incorporates specific minute external additive particles and the aforesaid specific minute external additive particles are subjected to retardation of the generation of excessive charge. Consequently, migration to the carrier is retarded, whereby it is possible to decrease the difference of charge providing capability between the carrier remained in the developing device and the newly replenished carrier. As a result, it is possible to narrow the charge amount distribution of the toner in the developing device, whereby it is further possible to retard the generation of toner scattering and background density increase. In addition, since the aforesaid specific minute external additive particles exhibit sufficient charging capability, it is possible to stably form high quality images over an extended period.

The reason, in which while the specific minute external additive particles, incorporated in a toner, exhibit sufficient charging capability, excessive charging is retarded and migration to the carrier is retarded, is assumed to be as follows.

Namely, silica, which is an oxide of silicon atoms, is readily charged and is structured to easily hold a charge. However, due to the structure of easily holding a charge, the charges tend to accumulate.

On the other hand, since oxides of titanium atoms and aluminum atoms exhibit relatively low resistance, they are capable of leaking a charge, while they result in difficulty of holding a charge.

It is further assumed that it is possible to retard excessive charge as follows. With regard to the specific minute external additive particles employed in the present invention, a large amount of silica components are oriented in the surface. Consequently, when colored particles are subjected to an addition treatment of external additives, sufficient charge providing capability is acquired. In addition, by holding a structure in which a large amount of relatively low resistant components such as titania and/or alumna are held in the interior, excessive charge generated by the silica component in the surface is leaked into the interior of the aforesaid minute external additive particles via the titania and/or alumina components existing in the interior.

The embodiments of the present invention are specifically described in the above, however the embodiments of the present invention are not limited thereto and it is possible to make various alterations.

EXAMPLES

Examples of the present invention will now be described, however the present invention is not limited thereto.

(Manufacturing Example of Resin Particle Dispersion)

(First Step Polymerization)

Placed into a 5 L reaction vessel fitted with a stirring unit, a temperature sensor, a cooling pipe, and a nitrogen introducing unit was a solution prepared by dissolving 8 g of sodium dodecyl sulfate in 3 L of ion-exchanged water, and while stirring at a rate of 230 rpm under a flow of nitrogen, the interior temperature was raised to 80° C. After rise in temperature, was added a solution, which was prepared by dissolving 10 g of potassium persulfate in 200 g of ion-exchanged water, and the solution temperature was again regulated to 80° C. Subsequently, a polymerizable monomer solution, composed of 480 g of styrene, 250 g of n-butyl acrylate, 68.0 g of methacrylic acid, and 16.0 g of n-octyl-3-mercaptopropionate, was dripped over one hour. Thereafter, polymerization was carried out by heating while stirring at 80° C. for two hours, whereby Resin Particle Dispersion (1H) incorporating Resin Particles (1h) was prepared.

(Second Step Polymerization)

Placed was Into a 5 L reaction vessel fitted with a stirring unit, a temperature sensor, a cooling pipe, and a nitrogen introducing unit, a solution prepared by dissolving 7 g of sodium polyoxyethylene-2-dodecylether sulfate in 800 mL of ion-exchanged water. After heating to 98° C., added were 260 g of above Resin Particle Dispersion (1H) and a polymerizable monomer solution prepared by dissolving 245 g of styrene, 120 g of butyl acrylate, 1.5 g of n-octyl-3-mercaptopropionate, and 67 g of releasing agent "HNP-11". The resulting mixture was blended and dispersed for one hour via a mechanical circulation channel holding system homogenizer "CREARMIX" (produced by M Technique Co.), whereby a dispersion incorporating emulsion particles (being oil droplets) was prepared.

Subsequently, added to the resulting dispersion was an initiating agent solution prepared by dissolving 6 g of potassium persulfate in 200 ml of ion-exchanged water. By heating the resulting system to 82° C. for one hour while stirring, polymerization was carried out, whereby Resin Particle Dispersion (1HM) incorporating Resin Particles (1hm) was prepared.

(Third Step Polymerization)

A solution, prepared by dissolving 11 g of potassium persulfate in 400 ml of ion-exchanged water, was added to above Resin Particle Dispersion (1HM) Under temperature condition of 82° C., a polymerizable monomer solution composed of 435 g of styrene, 130 g of n-butyl acrylate, 33 g of methacrylic acid, and 8 g of n-octyl-3-mercaptopropionate was dripped over one hour. After completion of dripping, polymerization was carried out by heating for two hours while stirring. Thereafter, the temperature was lowered to 28° C., whereby Resin Particle Dispersion (A) incorporating Resin Particles "a". The diameter of resin particle "a" in above Resin Particle Dispersion (A) was determined by employing an electrophoretic light scattering photometer "ELS-800" (produced by Otsuka Electronics Co., Ltd.), resulting in 150 nm in terms of volume based median diameter. Further, the glass transition temperature of above resin particles "a" was determined, resulting in 45° C.

Minute Colorant Particle Dispersion Manufacturing Example 1

While stirring, 420 g of carbon black "REGAL 330 R" (produced by Cabot Corp.) was gradually added to a solution prepared by dissolving 90 g of sodium dodecyl sulfate in 1,600 ml of ion-exchanged water, and the resulting mixture was subjected to dispersion treatment by employing stirring device "CLERAMIX" (produced by M Technique Co.), whereby Minute Colorant Particle Dispersion (Bk) was prepared.

Minute Colorant Particle Dispersion Manufacturing Examples 2-4

Minute Colorant Particle Dispersions (Y), (M), and (C) were prepared in the same manner as Minute Colorant Particle Dispersion Manufacturing Example 1, except that 420 g of carbon black was replaced with 310 g of C.I. Pigment Yellow 74, 310 g of C.I. Pigment Red 122, and 310 g of C.I. Pigment Blue 15, respectively.

Colored Particles Manufacturing Example 1

Placed Into a 5 L reaction vessel fitted with a stirring unit, a temperature sensor, a cooling pipe, and a nitrogen introducing unit, were 300 g of solids of Resin Particle Dispersion A, 1,400 g of ion-exchanged water, 120 g of Minute Colorant Particle Dispersion (Bk) and a solution prepared by dissolving 3 g sodium polyoxyethylene-2-dodecylether sulfate in 120 ml of ion-exchanged water. After regulating the solution temperature to 30° C., the pH was regulated to 10 by the addition of a SN sodium hydroxide solution. Subsequently, while stirring, an aqueous solution prepared by dissolving 35 g of magnesium chloride in 35 ml of ion-exchanged water was added over 10 minutes. The resulting mixture was allowed to stand for 3 minutes. Thereafter the temperature was raised to 90° C. over 60 minutes, and while maintaining the temperature at 90° C., the particle growing reaction was allowed to continue. In the above state, the diameter of coalesced particles was determined via "COULTER MULTISIZER-III". When the particle diameter reached the desired particle value, particle growth was terminated by the addition of an aqueous solution prepared by dissolving 150 g of sodium chloride in 600 ml of ion-exchanged water. Further, by heating the solution to 90° C. while stirring, fusion among particles was allowed to progress until the average roundness, determined by "PPIA-210", reached 0.965. Thereafter, the solution temperature was lowered to 30° C., and the pH was regulated to 4.0 by the addition of hydrochloric acid, followed by termination of stirring.

The colored particles formed in the above process were subjected to solid-liquid separation via a basket type centrifugal separator "MARK III TYPE Model No. 60×40" (produced by Matsumoto Machine Mfg. Co., Ltd.), and a wet cake of the colored particles was formed. The resulting wet cake was washed with ion-exchanged water via the above basket type centrifugal separator at 45° C. until electrical conductivity of the filtrate reached 5 μS/cm, and thereafter, transferred to "FLUSH JET DRYER (produced by Seishin Enterprise Co., Ltd.), followed by drying until the moisture content reached 0.5% by weight, whereby Colored Particles (Bk) were prepared.

Colored Particles Manufacturing Examples 2-4

Colored Particles (Y), (M), and (C) were prepared in the same manner as Colored Particle Manufacturing Example 1, except that Colored Particle Dispersion (Bk) was replaced with each of Colored Particle Dispersions (Y), (m), and (C).

Minute External Additive Particles Manufacturing Example 1

By employing the manufacturing facilities shown in FIG. 2, silicon tetrachloride vapor (A), titanium tetrachloride vapor (B), and aluminum chloride vapor (C) were introduced, together with inert gases, into a reaction chamber at a flow rate listed in the initial introduction amount column in Table 1, and a mixed gas which was prepared by mixing hydrogen and air at the specified ratio was combusted for 0.3 second at a combustion temperature of 2,000° C., whereby composite particles incorporating silicon atoms, titanium atoms, and aluminum atoms were formed. After cooling, collection was carried out via a filter.

The composite particles, prepared as above, were heated at 500° C. for one hour in an oven under ambient air to remove chlorine, and 500 parts by weight of the resulting particles were placed in a high speed stirring and blending device fitted with a heating and cooling jacket. While stirring at 500 rpm, 25 parts by weight of water was fed via spraying under sealed conditions, and stirring was carried out for an additional 10 minutes. Subsequently, 25 parts by weight of hexamethyldisilazane were added, and the resulting mixture was stirred for 60 minutes under sealed conditions. Thereafter, while stirring, nitrogen was passed at 150° C., and by removing formed ammonia gas and residual processing agents, Minute External additive Particles (1) composed of composite oxide particles were prepared.

Table 1 shows the coefficient $(R_1)/(R_2)$, the number average diameter of primary particles, the BET specific surface area, the bulk density, and the hydrophobic degree of the resulting minute external additive particles. Further, the coefficient $(R_1)/(R_2)$, the number average diameter of primary particles, the BET specific surface area, the bulk density, and the hydrophobic degree refer to those determined based on determination procedures described above.

Minute External Additive Particles Manufacturing Examples 2-5

Minute External additive Particles (2)-(5) were prepared in the same manner as Minute External additive Particle Manufacturing Example 1, except that silicon tetrachloride vapor (A), titanium tetrachloride vapor (B), and aluminum chloride vapor (C) were introduced into a reaction chamber from the main route as initial stage raw materials of the reaction at the flow rate listed in the Initial Introduction Amount column in Table 1 and they were also introduced into the reaction chamber from another route (not shown) as later stage materials of the reaction at the flow rate listed in the Later Stage Introduction Amount column of Table 1, whereby composite particles incorporating silicon atoms, titanium atoms, and aluminum atoms were formed.

Table 1 shows the $(R_1)/(R_2)$ coefficient, the number average diameter of primary particles, the BET specific surface area, the bulk density, and the hydrophobic degree of resulting Minute External additive Particles (2)-(5).

Minute External additive Particles Manufacturing Examples 6-10 and 13-15

Minute External additive Particles (6)-(10) and (13)-(15) were Prepared in the same manner as Minute External additive Particles Manufacturing Example 1, except that raw materials introduced into a combustion burner reaction furnace and their mixing ratio were changed as listed in Table 1.

Table 1 shows the $(R_1)/(R_2)$ coefficient, the number average diameter of primary particles, the BET specific surface area, the bulk density, and the hydrophobic degree of resulting Minute External additive Particles (6)-(10) and (13)-(15).

Minute External Additive Particles Manufacturing Example 11

Titanium dioxide particles (t), prepared in the same manner as Minute External additive Particles Manufacturing Example 14, and silica powder (s), prepared in the same manner as Minute External additive Particles Manufacturing Example 13 were previously blended in a resin bag to result in 9:1 by weight. The resulting mixture was put into a tank employing the manufacturing equipment described in FIG. 1, conveyed via an introducing pipe together with air as a carrier gas at a feeding rate of 4 kg/hour, and ejected from nozzles. At that time, the nozzle ejection flow rate of air was 48 m/second.

After the reaction, cooling air was introduced into the combustion furnace so that high temperature retention time in the combustion furnace was regulated to at most 0.3 second. Thereafter, manufactured fine powder (P) was collected employing a polytetrafluoropolyethylene bag filter.

Collected fine powder (P) was subjected to a chlorine removing treatment by heating at 500° C. for one hour under an ambient air in an oven. Subsequently, 500 parts by weight of the resulting fine powder were placed in a high speed stirring and mixing device, and while stirring at 500 rpm, 25 parts by weight were sprayed and fed under sealed conditions Thereafter, stirring was continuously carried out for 10 minutes. Subsequently, 25 parts by weight of hexamethyldisilazane were added and stirring was carried out for 60 minutes under sealed conditions. Thereafter, stirring and heating were carried out. While passing 140° C. nitrogen, formed ammonia gas and residual processing agents were removed, whereby Minute External additive Particles (11) were prepared.

Table 1 shows the $(R_1)/(R_2)$ coefficient, the number average diameter of primary particles, the BET specific surface area, the bulk density, and the hydrophobic degree of resulting of Minute External additive Particles (11).

Minute External Additive Particles Manufacturing Example 12

Minute External additive Particles (12) were prepared in the same manner as Minute External additive Particles Manufacturing Example 11, except that titanium dioxide particles (t) were replaced with aluminum oxide (a) prepared in the same manner as Minute External additive Particles Manufacturing Example 15.

Table 1 shows the $(R_1)/(R_2)$ coefficient, the number average diameter of primary particles, the BET specific surface area, the bulk density, and the hydrophobic degree of resulting of resulting Minute External additive Particles (12).

TABLE 1

| | Preparation | Initial Introducing Amount (weight %) | | | Later Stage Introducing Amount (weight %) | | | Constituting Element (weight %) | | | Coefficient | | | | BET Specific Surface Area | Bulk Density | Hydrophobic Degree |
|---|---|---|---|---|---|---|---|---|---|---|---|---|---|---|---|---|---|
| ** | Method | Si [A] | Ti [B] | Al [C] | Si [A] | Ti [B] | Al [C] | Si | Ti | Al | R1 | R2 | $R_1/R_2$ | *3 | ($m^2/g$) | (g/L) | (%) |
| 1 | *1 | 12 | 65 | 23 | — | — | — | 10 | 70 | 20 | 10.0 | 10.2 | 0.98 | 50 | 43 | 133 | 50 |
| 2 | *1 | 12 | 65 | 23 | 20 | 57 | 23 | 21 | 56 | 23 | 21.1 | 30.3 | 0.7 | 52 | 43 | 133 | 51 |
| 3 | *1 | 12 | 65 | 23 | 24 | 53 | 23 | 25 | 47 | 23 | 24.9 | 49.8 | 0.5 | 51 | 42 | 131 | 51 |
| 4 | *1 | 12 | 65 | 23 | 20 | 80 | — | 20 | 62 | 18 | 20.2 | 80.8 | 0.25 | 55 | 42 | 131 | 55 |
| 5 | *1 | 8 | 65 | 23 | 10 | 67 | 230 | 10 | 67 | 23 | 10.1 | 10.0 | 1 | 21 | 45 | 130 | 41 |
| 6 | *1 | 1.5 | 98.5 | — | — | — | — | 1 | 99 | — | 1.05 | 1.08 | 0.97 | 22 | 48 | 122 | 42 |
| 7 | *1 | 3 | 97 | — | — | — | — | 2.2 | 97.8 | — | 2.25 | 2.3 | 0.98 | 110 | 30 | 200 | 60 |
| 8 | *1 | 20 | 80 | — | — | — | — | 19 | 81.3 | — | 19.1 | 19.6 | 0.97 | 120 | 20 | 200 | 62 |

TABLE 1-continued

| | Preparation | Initial Introducing Amount (weight %) | | | Later Stage Introducing Amount (weight %) | | | Constituting Element (weight %) | | | | | Coefficient | | BET Specific Surface Area | Bulk Density | Hydro-phobic Degree |
|---|---|---|---|---|---|---|---|---|---|---|---|---|---|---|---|---|---|
| ** | Method | Si [A] | Ti [B] | Al [C] | Si [A] | Ti [B] | Al [C] | Si | Ti | Al | R1 | R2 | $R_1/R_2$ | *3 | ($m^2/g$) | (g/L) | (%) |
| 9 | *1 | 23 | 77 | — | — | — | — | 22 | 78.2 | — | 22.1 | 22.5 | 0.98 | 20 | 60 | 400 | 40 |
| 10 | *1 | 12 | — | 88 | — | — | — | 10 | — | 90 | 9.9 | 10.2 | 0.97 | 50 | 93 | 46 | 50 |
| 11 | *2 | 10 | 90 | — | 40 | 60 | — | 25 | 75 | — | 25.2 | 40.3 | 0.625 | 55 | 42 | 130 | 55 |
| 12 | *2 | 10 | — | 90 | 40 | — | 60 | 25 | — | 75 | 25.0 | 40.0 | 0.625 | 57 | 42 | 130 | 56 |
| 13 | *1 | 100 | — | — | — | — | — | 100 | — | — | 100.0 | 100.0 | 1 | 40 | 41 | 128 | 45 |
| 14 | *1 | — | 100 | — | — | — | — | — | 100 | — | 0.0 | 0.0 | — | 21 | 43 | 131 | 41 |
| 15 | *1 | — | — | 100 | — | — | — | — | — | 100 | 0.0 | 0.0 | — | 15 | 87 | 50 | 35 |

** Minute External Additive Agent Particles No.,
*1: gas phase method via vapor
*2: gas phase method employing powers,
*3: Number Average Diameter of Primary Particles (nm)

(Toner Manufacturing Examples Bk1-Bk8 and Bk10-Bk15

Each of Minute External additive Particles (1)-(8) and (10)-(15) was added to Colored Particles (Bk) to reach the added amount listed in Table 2. After stirring the resulting mixture for 30 minutes at a temperature of 30° C. by employing Henschel mixer "FM10B" (produced by Mitsui Miike Machinery Co., Ltd.) set at a peripheral rate of the stirring blade of 35 m/second, coarse particles were removed by employing a sieve of a pore of 90 μm, whereby each of Toners (Bk1)-(Bk8) as well as (Bk10-(Bk15) was prepared. Incidentally, the shape and diameter of these toner particles resulted in no change by the addition of minute external additive particles.

Toner Manufacturing Example Bk9

Further, Toner (Bk9) was prepared in the same manner as Toner Manufacturing Example Bk1, except that Minute External additive Particles (1) was replaced with Minute external additive Particles (9), and 0.2 part by weight of hydrophobic silica (at a particle diameter of 7 nm), and 0.2 part by weight of hydrophobic silica at a particle diameter of 21 nm) were added. Incidentally, the shape and diameter of these toner particles resulted in no change by the addition of minute external additive particles.

Toners (Bk1)-(Bk4) and (Bk6)-(Bk12) are those which relate to the present invention, while Toners (Bk5) and (Bk13)-(Bk15) are comparative toners.

Toner Manufacturing Examples Y1-Y15

Each of Toners (Y1)-(Y15) was prepared in the same manner as Toner Manufacturing Examples Bk1-BK15, except that Colored Particles (Bk) were replaced with Colored Particles (Y)

Toners (Y1)-(Y4) and (Y6)-(Y12) are those which relate to the present invention, while Toners (Y5) and (Y13)-(Y15) are comparative toners.

Toner Manufacturing Examples M1-M15

Each of Toners (M1)-(M15) was prepared in the same manner as Toner Manufacturing Examples Bk1-Bk15, except that Colored Particles (Bk) were replaced with Colored Particles (M).

Toners (M1)-(M4) and (M6)-(M12) are those which relate to the present invention, while Toners (M5) and (M13)-(M15) are comparative toners.

Toner Manufacturing Examples C1-C15

Each of Toners (C1)-(C15) was prepared in the same manner as Toner Manufacturing Examples Bk1-BK15, except that Colored Particles (Bk) were replaced with Colored Particles (C).

Toners (C1)-(C4) and (C6)-(C12) are those which relate to the present invention, while Toners (C5) and (C13)-(C15) are comparative toners.

Two Component Developer Manufacturing Examples Bk1-Bk15, Y1-Y15, M1-M15, and C1-C15

Each of Two Component developers (Bk1)-(Bk15), (Y1)-(Y15), (M1-M15), and (C1)-(C15) was prepared by blending a silicone resin coated ferrite carrier at a volume average diameter of 60 am with each of Toners (Bk1)-(Bk15), (Y1)-(Y15), (M1)-(M15), and (C1)-(C15) so that the toner concentration reached 6%.

Further, Fresh Developers (Bk1)-(Bk15), (Y1)-(Y15), (M1-M15), and (C1)-(C15) for replenishment were prepared in the same manner as above, except that blending was carried out so that the toner concentration reached 75%.

Examples 1-11 and Comparative Examples 1-4

Tow Component Developers (Bk1)-(Bk15), (Y1)-(Y15), (M1)-(M15), and (C1)-(C15) were employed in combinations of ((BK1)/(Y1)/(M1)/(C1))-((Bk15)/(Y15)/(M15)/(C15)). Further, while replenishing corresponding Fresh Developers (Bk1)-(Bk15), (Y1)-(Y15), (M1)-(M15), and (C-1)-(15), digital copier "bizhub PRO C500" (produced by Konica Minolta Corp.) was employed which was modified as the developing device shown in FIG. 4 to enable employment of the trickle developing system. A test color image at a pixel ratio of 10% was printed onto 100,000 image supports of an A4 size in one sheet intermittent mode, and background density and toner scattering were evaluated, as described below. Table 2 shows the results.

(Evaluation of Background Density)

Initially, with regard to an image support, composed of a white paper, which is not printed, absolute image density at 20 positions was determined via Macbeth densitometer "RD-918" (produced by Macbeth Co., Ltd.), and by averaging the resulting values, white paper density was obtained. Subsequently, with regard to the white portion of the test image of the 50,000th print and also the 100,000th print, the absolute image density at 20 randomly selected positions was determined in the same manner as above, and an average value was obtained. A value obtained by subtracting the white paper density from the above density was designated as background density, followed by evaluation based on the following criteria. Incidentally, when the background density is at most 0.01, the resulting background is regarded as one which results in no practical problem.

A: less than 0.003

B: equal to or more than 0.003-less than 0.006

C: equal to or more than 0.006 at most 0.010

D: equal to or more than 0.010

(Evaluation of Toner Scattering)

After printing the test image onto 100,000 sheets, the toner scattering state was visually evaluated based on the following criteria. Incidentally, when the resulting evaluation is A, B, or C, it may be possible to mention that no practical problems occur.

(Evaluation Criteria)

A: no toner scattering was noted near the developing unit

B: adhesion of scattered toners was noted on the top lid near the developing unit C: adhesion of scattered toners was noted on one part of the top lid near the developing unit D: adhesion of a large amount of scattered toners was noted on the top lid near the developing unit.

TABLE 2

| | Toner No. | Minute External additive Particles No. | Added Amount (wt %) | Evaluation of Background Density 50,000th Print | 100,000th Print | Toner Scattering |
|---|---|---|---|---|---|---|
| Example 1 | 1 | 1 | 0.8 | B | C | C |
| Example 2 | 2 | 2 | 0.8 | B | B | B |
| Example 3 | 3 | 3 | 0.8 | A | A | A |
| Example 4 | 4 | 4 | 0.8 | A | A | A |
| Comp. 1 | 5 | 5 | 0.8 | D | D | D |
| Example 5 | 6 | 6 | 0.8 | B | C | C |
| Example 6 | 7 | 7 | 1.5 | B | C | C |
| Example 7 | 8 | 8 | 1.5 | B | C | C |
| Example 8 | 9 | 9 | 0.8 | B | C | C |
| Example 9 | 10 | 10 | 0.8 | B | C | C |
| Example 10 | 11 | 11 | 0.8 | B | B | B |
| Example 11 | 12 | 12 | 0.8 | B | B | B |
| Comp. 2 | 13 | 13 | 0.8 | D | D | D |
| Comp. 3 | 14 | 13 + 14 | 0.4 + 0.4 | D | D | D |
| Comp. 4 | 15 | 13 + 15 | 0.4 + 0.4 | D | D | D |

Comp.: Comparative Example

As can clearly be seen from Table 2, it was confirmed that Examples 1-11 resulted in retardation of an increase in background density and toner scattering while employed over an extended period.

What is claimed is:

1. A method for forming an image comprising the steps of:

(a) forming an electrostatic latent image on an electrostatic latent image carrier; and (b) developing the electrostatic latent image by a two component developer comprising a toner and a carrier, wherein the two component developer is continually replenished in the developing step (b); and the toner comprises:

colored particles; and external additive particles comprising a complex oxide incorporating silicon atoms and at least one of titanium atoms and aluminum atoms, and a surface existing ratio of the silicon atoms ($R_2$) in a surface of the external additive particles being larger than an average existing ratio of the silicon atoms ($R_1$) in an entirety of the external additive particles, provided that the surface existing ratio of the silicon atoms ($R_2$) is defined as a value obtained from a weight of silicon atoms in the surface divided by the total weight of the silicon atoms, the titanium atoms and the aluminum atoms in the surface; and the average existing ratio of the silicon atoms ($R_1$) is defined as a value obtained from a weight of silicon atoms in the entirety of the external additive particles divided by the total weight of the silicon atoms, the titanium atoms and the aluminum atoms in the entirety of the external additive particles.

2. The method for forming an image of claim 1, wherein a total amount of the titanium atoms and the aluminum atoms contained in the external additive particles is higher than an amount of the silicon atoms in the external additive particles.

3. The method for forming an image of claim 1, wherein a coefficient of $(R_1)/(R_2)$ is not more than 0.7, where ($R_1$) is the average existing ratio of the silicon atoms in the entirety of the external additive particles, and ($R_2$) is the surface existing ratio of the silicon atoms in the surface of the external additive particles.

4. The method for forming an image of claim 1, wherein a coefficient of $(R_1)/(R_2)$ is not more than 0.5, where ($R_1$) is the average existing ratio of the silicon atoms in the entirety of the external additive particles, and ($R_2$) is the surface existing ratio of the silicon atoms in the surface of the external additive particles.

5. The method for forming an image of claim 1, wherein a coefficient of $(R_1)/(R_2)$ is not more than 0.25, where ($R_1$) is the average existing ratio of the silicon atoms in the entirety of the external additive particles, and ($R_2$) is the surface existing ratio of the silicon atoms in the surface of the external additive particles.

6. The method for forming an image of claim 1, wherein the average existing ratio of the silicon atoms ($R_1$) is from 1 to 20 weight %.

7. The method for forming an image of claim 1, wherein the external additive particles have a number average primary particle diameter of 20 to 200 nm.

8. The method for forming an image of claim 1, wherein the external additive particles have a BET specific surface area of 2-100 $m^2/g$.

9. The method for forming an image of claim 1, wherein the external additive particles have a bulk density of 100-400 g/L.

10. The method for forming an image of claim 1, wherein the external additive particles have a degree of hydrophobicity of 30% or more.

11. A two component developer comprising a toner and a carrier, provided that the two component developer is continually replenished in a developing step in an image forming method in which an electrostatic latent image formed on an electrostatic latent image carrier is developed by the two component developer, wherein the toner comprises:

colored particles; and external additive particles comprising a complex oxide incorporating silicon atoms and at least one of titanium atoms and aluminum atoms, and a surface existing ratio of the silicon atoms ($R_2$) in a surface of the external additive particles being larger than an average existing ratio of the silicon atoms ($R_1$) in an entirety of the external additive particles, provided that the surface existing ratio of the silicon atoms ($R_2$) is defined as a value obtained from a weight of silicon atoms in the surface divided by the total weight of the silicon atoms, the titanium atoms and the aluminum atoms in the surface; and the average existing ratio of the silicon atoms ($R_1$) is defined as a value obtained from a weight of silicon atoms in the entirety of the external additive particles divided by the total weight of the silicon atoms, the titanium atoms and the aluminum atoms in the entirety of the external additive particles.

12. The two component developer of claim 11, wherein a total amount of the titanium atoms and the aluminum atoms contained in the external additive particles is higher than an amount of the silicon atoms in the external additive particles.

13. The two component developer of claim 11, wherein a coefficient of $(R_1)/(R_2)$ is not more than 0.7, where ($R_1$) is the average existing ratio of the silicon atoms in the entirety of the external additive particles, and ($R_2$) is the surface existing ratio of the silicon atoms in the surface of the external additive particles.

14. The two component developer of claim 11, wherein a coefficient of $(R_1)/(R_2)$ is not more than 0.5, where ($R_1$) is the average existing ratio of the silicon atoms in the entirety of the external additive particles, and ($R_2$) is the surface existing ratio of the silicon atoms in the surface of the external additive particles.

15. The two component developer of claim 11, wherein a coefficient of $(R_1)/(R_2)$ is not more than 0.25, where ($R_1$) is the average existing ratio of the silicon atoms in the entirety of the external additive particles, and ($R_2$) is the surface existing ratio of the silicon atoms in the surface of the external additive particles.

16. The two component developer of claim 11, wherein the average existing ratio of the silicon atoms ($R_1$) is from 1 to 20 weight %.

17. The two component developer of claim 11, wherein an number average diameter of primary particles of the external additive particles is 20 to 200 nm.

18. The two component developer of claim 11, wherein the external additive particles have a BET specific surface area of 2-100 $m^2/g$.

19. The two component developer of claim 11, wherein the external additive particles have a bulk density of 100-400 g/L.

20. The two component developer of claim 11, wherein the external additive particles have a degree of hydrophobicity of 30% or more.

* * * * *